United States Patent [19]

Ansite

[11] Patent Number: 4,494,538

[45] Date of Patent: Jan. 22, 1985

[54] MASK ASSEMBLY

[75] Inventor: William K. Ansite, Glendale, Calif.

[73] Assignee: Figgie International Inc., Willoughby, Ohio

[21] Appl. No.: 482,622

[22] Filed: Apr. 6, 1983

[51] Int. Cl.[3] ..... A62B 7/00

[52] U.S. Cl. ..... 128/205.25; 128/201.25; 128/202.27; 128/205.22; 128/207.11

[58] Field of Search ..... 128/201.23, 201.25, 128/201.28, 205.12, 204.18, 205.25, 205.29, 206.12, 206.15, 206.17, 205.22, 202.27

[56] References Cited

U.S. PATENT DOCUMENTS

| | | | |
|---|---|---|---|
| 2,383,649 | 8/1945 | Heidbrink | 128/206.29 |
| 3,013,556 | 12/1961 | Galleher, Jr. | 128/207.11 |
| 3,695,264 | 10/1972 | Laeral | 128/145.5 |

FOREIGN PATENT DOCUMENTS

| | | | |
|---|---|---|---|
| 1085427 | 7/1960 | Fed. Rep. of Germany | 128/204.26 |
| 510491 | 8/1939 | United Kingdom . | |
| 1395391 | 5/1975 | United Kingdom . | |
| 1401613 | 7/1975 | United Kingdom . | |
| 1522861 | 8/1978 | United Kingdom . | |
| 2044410 | 3/1980 | United Kingdom . | |

*Primary Examiner*—Henry J. Recla

*Attorney, Agent, or Firm*—Christel, Bean & Linihan

[57] ABSTRACT

A mask assembly (10) adapted for use with a portable ventilator/resuscitator (30) and which is adapted to be either placed directly over a patient's face or to be connected to a gas mask (18) worn by the patient, the gas mask having an inlet and an exhalation valve (26). The mask assembly includes an oral nasal mask (12) which can be placed over the patient's nose and mouth, holding means (16) including a head harness (58) and adjustable straps (60) which are capable of holding the mask (12) over a patient's face, and tubing means (14) having one end (28) connected to the portable ventilator/resuscitator (30) and the other end provided with a connector tube which, when the mask is in an inverted shape, can be snap fit into an annular opening in the end wall (22) of a filter (20) of the gas mask (18). The mask assembly (10) is further provided with pressure compensating means (38) capable of blocking the exhalation valve (26) of the gas mask.

9 Claims, 4 Drawing Figures

MASK ASSEMBLY

FIELD OF THE INVENTION

The present invention relates generally to a mask assembly which is adapted to be connected to a portable source of pressurized breathing gas, and more particularly to a mask assembly which either may be placed directly over a patient's nose and mouth or in the alternative may be connected to the inlet of a gas mask worn by the patient.

BACKGROUND OF THE INVENTION

Various personnel may be required to operate in conditions where harmful gases may be present in the atmosphere, which gases could cause respiratory failure. In view of the nature of the environment in which these people may be required to work they are customarily provided with gas masks provided with filters capable of filtering out the harmful gases. There is a requirement that a portable ventilator/resuscitator be provided which is capable for use with such personnel who are suffering respiratory failure and who are either wearing a gas mask of the type described above, or, in the alternative, who are not wearing such a mask. Thus, the portable ventilator/resuscitator must be provided with a mask assembly of the type which is capable of use with a patient wearing a gas mask, or, alternatively, with a patient who is not wearing a gas mask.

OBJECTS AND SUMMARY OF THE INVENTION

It is an object of the present invention to provide a mask assembly which is adapted for use with a portable ventilator/resuscitator and is adapted to be either placed directly over a patient's face, or, alternatively, to be connected to a gas mask worn by the patient, the gas mask having an inlet to which the mask assembly can be connected.

Such a mask assembly would preferably include an oral nasal mask which can be placed over a patient's nose and mouth, tubing means having one end connected to a source of gas, and the other end terminating in a connector tube which may be held within the inlet of a gas mask, the tubing means passing through the oral nasal mask in a gas tight relationship, and a head harness and straps which are capable of holding the oral nasal mask over the patient's face in the event the patient is not wearing a gas mask.

The foregoing and other objects and advantages of the present invention will become more apparent from a consideration of the following detailed description taken in conjunction with the accompanying drawings in which a preferred form of this invention is illustrated.

DETAILED DESCRIPTION

Figure 1:
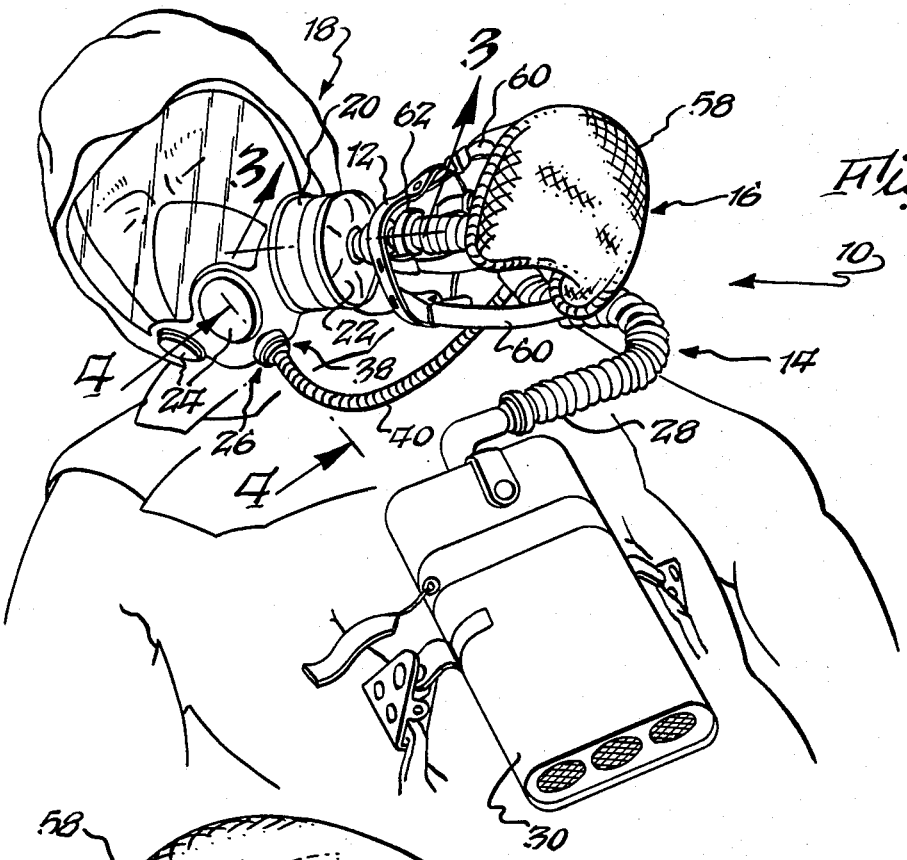
FIG. 1 is a view of the oral nasal mask assembly of this invention in combination with a single patient gas operated ventilator/resuscitator, the mask assembly of this invention being shown in its inverted position and connected directly to a gas mask worn by a patient.
Figure 2:
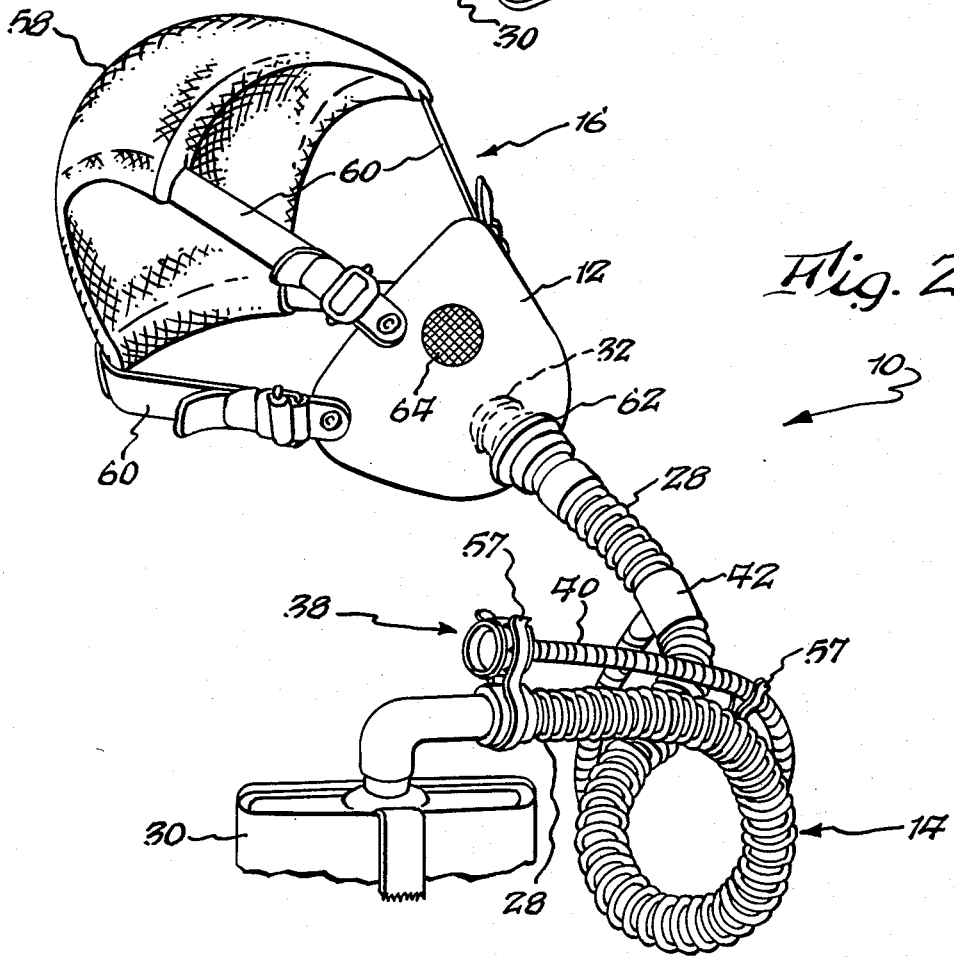
FIG. 2 is a view illustrating the oral nasal mask assembly of this invention in a normal position and adapted to be placed directly over a patient's face.

Preferring first to FIGS. 1 and 2 the mask assembly of this invention is indicated generally at 10 and includes as its principal component parts an oral nasal mask 12, tubing means indicated generally at 14, and means capable of holding the mask over a patient's face, the holding being indicated generally at 16. The mask assembly can be either connected to a patient's gas mask in the manner indicated in FIG. 1 in which case the mask will be in an inverted form, or alternatively, the mask can be turned inside out from the position shown in FIG. 1 to the position indicated in FIG. 2 and placed directly over a patient's face. The gas mask shown in FIG. 1 is of the type which may be worn by U.S. Army field personnel and totally encloses the head of the wearer. The gas mask, which is indicated generally at 18, is provided with a filter 20 having an end wall 22 provided with a circular inlet opening. The mask is also provided with voice transmitting portions 24 and an exhalation valve indicated generally at 26. While not indicated in the figures there is customarily a one-way valve between the filter 20 and the mask 18 which permits air to be drawn into the mask by the patient through the filter opening 22 and to be exhaled only through the exhalation valve 26. While the oral nasal mask assembly of this invention is designed specifically for use with a gas mask of the type illustrated in FIG. 1, it should be appreciated that the mask assembly of this invention may be associated with other forms of gas masks provided with an inlet, which inlet could also be utilized for exhalation purposes.

Figure 3:
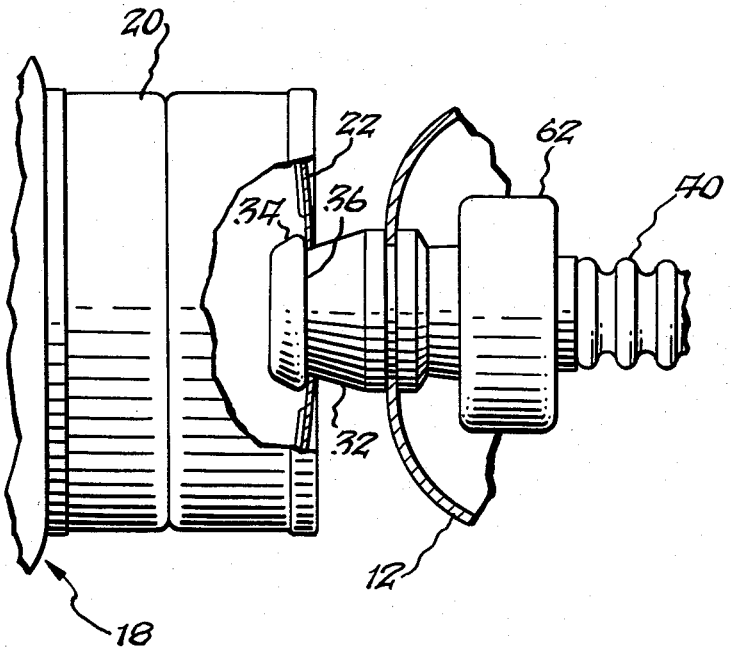
FIG. 3 is a section taken generally along the line 3—3 in FIG. 1.
Figure 4:
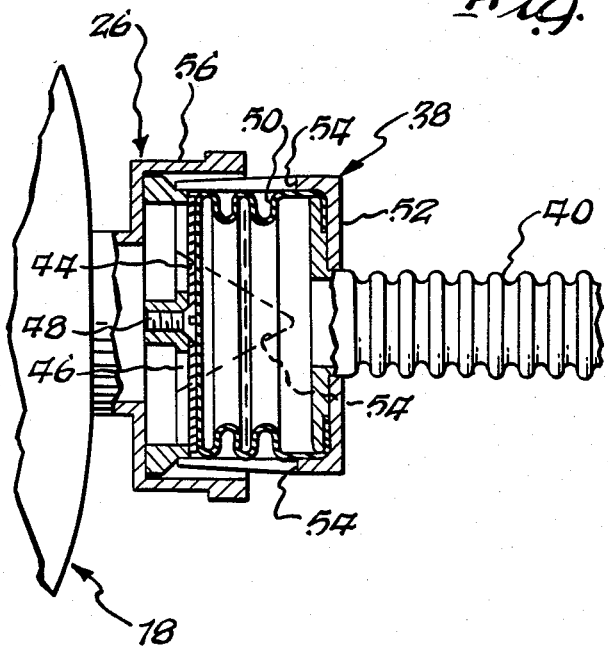
FIG. 4 is a section taken generally along the line 4—4 in FIG. 1.

The tubing means 14 has one end 28 associated with a source of pressurized breathing gas, for example as portable ventilator/resuscitator 30. The other end of the tubing means terminates in connector tube means 32 best shown in FIG. 3. A portion of the tubing means passes through an aperture in the oral nasal mask 12 in airtight relationship. It should be noted that the connector tube means 32 may be made of a resilient material, such as a closed cell neoprene material, the connector tube terminating in a flange having a conical outer surface 34 which may be inserted into the aperture in the end wall 22 and then compressed until the shoulder 36 passes the edge of the aperture at which point the connector tube snap fits into the circular inlet opening in an airtight relationship as illustrated in FIG. 3.

When used with the gas mask it is necessary to provide some means to block the exhalation valve 26 of the gas mask during inspiration but which will permit the exhalation valve to function in its novel manner during expiration. To this end pressure compensating means indicated generally at 38 are provided, the pressure compensating means including a tube 40 which may be connected to the tubing means 14 by a T connector 42. The relief valve with which the pressure compensating means is adapted to be used includes a resilient flapper valve 44 normally held over an apertured plate 46 by means of a set screw 48. The pressure compensating means 38 further includes a bladder 50 held within a cylindrical housing 52 provided with spaced apart apertures 54, the housing being adapted to be received and held within a corresponding cylindrical member 56 which is disposed about the exhalation valve 26. It should be noted that during the operation of the apparatus that when the ventilator/resuscitator is in its normal inspiratory cycle, the bladder 50 will be inflated and will cause the flapper valve 44 to be held in its closed position. However, during the expiratory phase, the bladder will be permitted to collapse so that air may pass through the apertured plate 46, past the flapper valve 40, and exit through the apertures 54. When the pressure compensating means 38 is not in use, it is held, along with tube 40, in a storage position shown in FIG. 2 by clips 57.

When the oral nasal mask assembly of this invention is utilized with a patient not wearing a gas mask, the mask 12, is turned inside out from the position shown in FIG. 1 to the position indicated in FIG. 2 and the holding means 16, which include a head harness 58 and adjustable straps 60, is placed about the patient's head. In order to provide for exhalation, a combined pressure compensated inhalation/exhalation valve 62 is utilized (FIG. 3) which valve corresponds generally to that valve shown in U.S. Pat. No. 3,342,200, the disclosure of which is incorporated herein by reference thereto. In this type of mask an anti-suffocation valve may be provided, the anti-suffocation valve 64 being provided with a gas filter.

In operation, rescue personnel are provided with a portable ventilator/resuscitator 30 with which the mask assembly 10 of this invention is associated. The mask 12 will, before initial use, normally be disposed in the inverted position illustrated in FIG. 1. If the patient is wearing a gas mask, the connector tube means 32 is forced into the annular opening in the end wall 22 of the filter 20 into a snap fit gas tight relationship therewith, and the pressure compensating means 38 is placed over the exhalation valve 26. The ventilator/resuscitator's operation is then initiated and breathing gas under pressure will be periodically forced into the lungs of the patient until the operation of the ventilator/resuscitator is discontinued. In the event that the patient is not wearing a gas mask, the inverted mask 12 is moved to its normal position shown in FIG. 2, and then the harness 58 is placed behind the patient's head with a mask 12 over his nose and mouth. The straps 60 are then adjusted to firmly secure the mask in place. Operation of the resuscitator can be commenced once the mask is in this position.

It should be seen that the present mask assembly is suitable for use either with a patient wearing a gas mask or with a patient without a gas mask and thus does not require the rescuer to remove the gas mask of a patient who is wearing one.

While a preferred structure in which the principles of the present invention have been incorporated are shown and described above, it is to be understood that this invention is not to be limited to the particular details shown and described above, but that, in fact, widely differing means may be employed in the broader aspects of this invention.

What is claimed is:

1. A oral nasal mask assembly adapted for use with a source of pressurized breathing gas and adapted to be either placed directly over a patient's face or to be connected to a gas mask previously being worn by the patient, said gas mask having an exhalation valve and a filter for filtering gases passing into the gas mask, said filter including means defining an inlet; said oral nasal mask assembly comprising:

an oral nasal mask which can be placed over the face of a patient:

a source of pressurized breathing gas;

tubing means having one end connected to said source of pressurized breathing gas, connector tube means connected to said oral nasal mask and having a first end extending into and terminating within said oral nasal mask and an opposite second end connected to the other end of said tubing means, said first end of said connector tube means adapted to be secured within the inlet of said gas mask in an airtight relationship; and holding means capable of holding the oral nasal mask over a patient's face in the event the patient is not wearing a gas mask.

2. The mask assembly as set forth in claim 1 in which the oral nasal mask assembly is further provided with pressure compensating means capable of blocking the exhalation valve of the gas mask during inspiration, but capable of unblocking the exhalation valve during expiration.

3. The mask assembly as set forth in claim 1 further including a pressure compensated inhalation/exhalation valve fluidically connected in said tubing means.

4. The gas mask assembly as set forth in claim 1 in which said first end of said connector tube means is adapted to be snap fitted into said inlet.

5. The mask assembly as set forth in claim 4 wherein said first end of said connector tube means is provided with a conical outer surface which may be compressed during insertion into said inlet and which can expand back to its normal form after insertion to hold said connector tube within said inlet.

6. The mask assembly as set forth in claim 4 wherein said connector tube means is formed of resilient material.

7. The mask assembly as set forth in claim 1 further including an anti-suffocation valve in series communication with a gas filter fluidically connected to the interior of said oral nasal mask.

8. The mask assembly as set forth in claim 1 in which the holding means capable of holding the mask to the patient's head is a head harness and strap assembly connecting the oral nasal mask to the head harness.

9. The mask assembly as set forth in claim 1 in which the source of pressurized breathing gas is a portable ventilator/resuscitator.

* * * * *